United States Patent [19]

Chateau

[11] 4,020,816

[45] May 3, 1977

[54] ELECTRONIC IGNITION DEVICE FOR AN INTERNAL COMBUSTION ENGINE

[75] Inventor: Louis Chateau, Rosny-sur-Bois, France

[73] Assignee: Ducellier et Co., Paris Cedex, France

[22] Filed: July 28, 1975

[21] Appl. No.: 599,337

[30] Foreign Application Priority Data

July 31, 1974 France ..... 74.26580
Feb. 24, 1975 France ..... 75.05594

[52] U.S. Cl. ..... 123/148 E; 123/179 BG; 315/209 T; 330/207 P; 361/91; 361/18; 361/263

[51] Int. Cl.[2] ..... F02P 1/00

[58] Field of Search ... 123/148 R, 148 AC, 148 DC, 123/148 E, 148 CB, 148 CC, 179 BG, 198 D, 198 DC; 307/202 R, 315; 317/31, 43, 50; 330/207 P; 315/209 R, 209 T

[56] References Cited

UNITED STATES PATENTS

| | | | |
|---|---|---|---|
| 3,078,391 | 2/1963 | Bunodiere et al. | 123/148 CA |
| 3,319,146 | 5/1967 | Kearsley | 307/202 |
| 3,489,927 | 1/1970 | Kelley et al. | 307/202 |
| 3,745,985 | 7/1973 | Höhne | 123/148 E |
| 3,765,391 | 10/1973 | Cook | 315/209 T |
| 3,861,369 | 1/1975 | Canup | 123/148 E |
| 3,882,840 | 5/1975 | Adamian et al. | 123/148 E |
| 3,940,658 | 2/1976 | Allred | 315/209 R |
| 3,949,722 | 4/1976 | Linstedt et al. | 315/209 T |

FOREIGN PATENTS OR APPLICATIONS

| | | |
|---|---|---|
| 2,237,503 | 7/1975 | France |
| 1,451,436 | 2/1966 | France |

*Primary Examiner*—C. J. Husar
*Assistant Examiner*—Paul Devinsky

[57] ABSTRACT

An electronic ignition control device for an internal combustion engine includes a power amplifier which controls current through an ignition coil and a triggering circuit for the power amplifier. To protect the power amplifier against damage resulting from being connected to a higher voltage source during starting there is a protection circuit which switches off the power amplifier when an over voltage is detected but allows it to switch on for a very short period when a spark is required. The protection circuit uses conventional logic elements, sensing the output of the triggering means, the output of a delay circuit driven by the triggering means, and the output of an over voltage sensing circuit.

3 Claims, 4 Drawing Figures

ELECTRONIC IGNITION DEVICE FOR AN INTERNAL COMBUSTION ENGINE

The present invention concerns an electronic ignition device for an internal combustion engine, particularly for motor vehicles, which device is of the type comprising an ignition triggered element, a voltage step-up coil, means for protection, acting to block the output stage, of an amplifier element, when a voltage source of higher value than the normal usage value is used during the starting phase of the engine, and means for cutting out this protection, by delaying circuit, for a sufficient duration to ensure the production of an ignition spark at the electrodes of at least one plug.

Such an ignition device is known in French Pat. No. 73.25419 in which two delaying circuits are provided including two condensers.

Because of the condensers, these circuits cannot be integrated using current techniques, which prevents an optimum embodiment in the case of an inegrated circuit. Furthermore, the device does not permit a variation in the mark-to-space ratio of the coil charging signal in order to obtain a regulated current consumption during the ignition operation.

Moreover, the amplifier stage of the device is not protected when the voltage in the primary winding of the coil is negative, due to transient over-voltages.

The object of the present invention is to remedy these disadvantages and to this effect it concerns a device of the above-mentioned type, characterised in that the cut-out means is a logic circuit which receives the information signals from the delay circuit, and from the protection circuit of the power amplifier, such that, the supply voltage being greater than a defined value, the duration of charge of the coil is very sharply reduced.

The invention also provides a parallel diode-capacitor combination connected between the base of an input transistor of the power amplifier and the emitter of an output transistor thereof to protect both transistors against damage by transient reverse voltages at the instant of ignition.

The description which follows with reference to the accompanying diagrams, will facilitate a better understanding of how the invention may be carried out:

Figure 1:
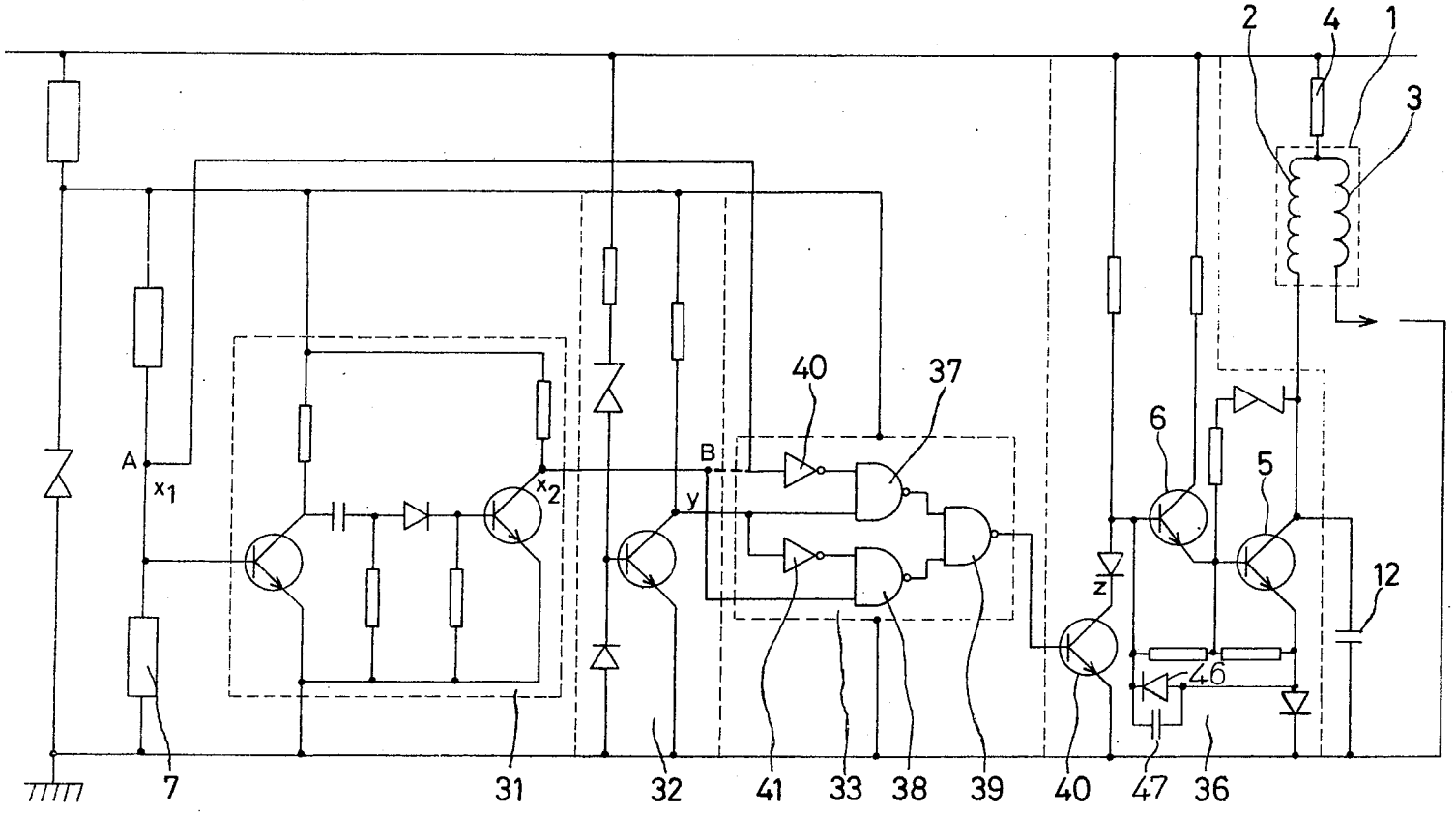
FIG. 1 shows schematically a first preferred embodiment of the invention.

The device shown in FIG. 1 includes triggering means 7 for ignition triggering, a delay circuit 31 as described particularly in French Pat. No. 1.451.436 of 19.7.65., a protection means 32, overriding means 33 for cutting out this protection, power amplifier 36, an ignition condenser 12, an ignition coil 1 and its current limiting resistance 4.

The device 33 for cutting out the protection is preferably formed from simple logic elements currently used, such as inverters 40, 41 and "NAND" gates 37, 38, 39.

This device 33 receives at its input the information signals $x2$, $x1$, $y$, respectively from the delaying device 31, the ignition triggering means 7, and the protection means 32. Each information signal has two states 0 and 1.

These states are defined in the following manner: when the protection means 32 is subjected to a supply voltage higher than a certain value, such as 20 Volts for example, the information signal $y$ is in the state 0, in the other case, i.e. when the voltage is less than 20 Volts, the information signal $y$ is in the state 1.

When the delaying circuit 31 is operative, at B, see FIG. 1, the information signal x2 is in the state 0, and when it is not operative, the information signal $x2$ is in the state 1.

In the same way at A, the information signal $x$ is in the state 0 or 1 according to the position of the triggering element 7.

The state $z$ of a transistor 42 is a function of the combination of the different states of the information signals $x1$, $x2$ and $y$.

The operation of such a device (see FIG. 2) is then as follows: for a supply voltage less than 20 Volts, $y$ is in the state 1; the element 37 receives this information signal in its state 1, whilst the element 38 receives this information in its state 0, this is due to the presence of the inverter 41, the element 38 is inactive and the signal from the element 37 is a function of the state of the information signal $x1$, i.e. when the information signal x1 is in the state 1, the information signal at the output of the inverter 40 is in the state 0, and as a result the information signal at the output of the element 37 is in the state 1, and thus the element 39, which receives two information signals in the state 1 supplies one information signal in the state 0; the transistor 42 which receives this information signal from the output of the element 39 is thus blocked; its information signal z is thus in the state 1; the transistors 5 and 6 are then conducting, establishing the flow of current in the primary 2 of the coil 1. When the information signal $x1$ is in the state 0, $z$ is in the state 0 since the transistor 40 is conducting; the transistors 5 and 6 are blocked; the ignition spark is created at the occurrence of the descending front of $x1$.

When the supply voltage is greater than 20 Volts, the protection means 32 is operative, the information signal $y$ is at the level 0, the information signal received by the element 37 is thus in the state zero and that of the element 38 is in the state 1. The element 37 is thus no longer operative and the element 38 is operative. The signal $z$ is thus a function of the information signal $x2$ emitted by the delaying circuit 31, that is to say that when $x2$ is in the state 0, z is in the state 1, the ignition coil charges and when x2 is in the state 1, $z$ is in the state 0, and at that moment the instant of ignition corresponds to the occurrence of the rising front of $x2$.

In a variation of the system and particularly when the ignition signals $x1$ cannot be used directly to control the start of charging of the ignition coil, the desired result is obtained by omitting the connection between A and the device 33 (see FIG. 1 broken lines) and by bringing the point A into coincidence with the point B; in the case x1 = x2. The operation is then as follows (see FIG. 3): when the element 37 receives the information signal $y=1$, the signal x2 which operates is that which passes through the inverter 40; when the element 37 receives $y=0$, it is the element 38 which comes into action, as well as the signal x2 which arrives directly at the element 38, i.e. according to FIG. 3, when the protection device 33 is not in operation, the point of ignition occurs at the descending front of x2, and when it is in operation, the point of ignition occurs at the rising front of $x2$.

Figure 2:
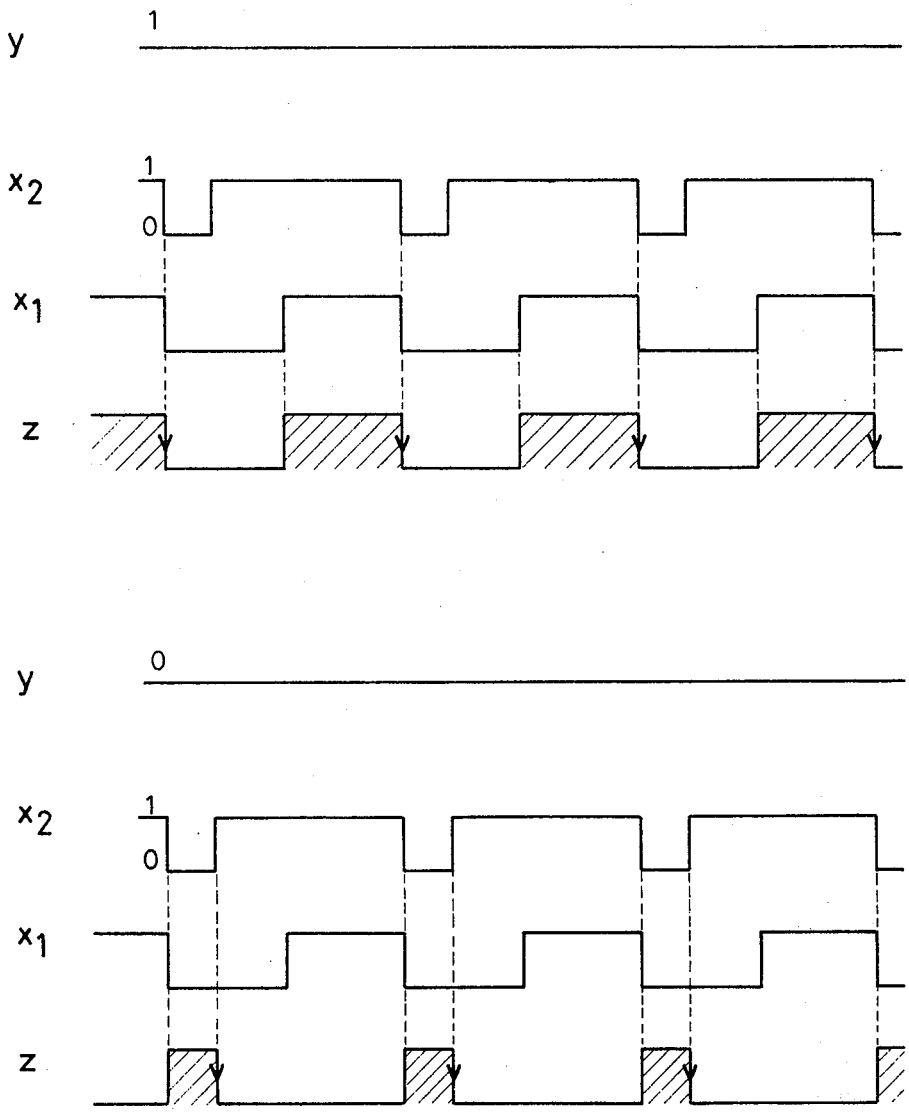
FIG. 2 is a diagram of the signals at various points of the device.
Figure 3:
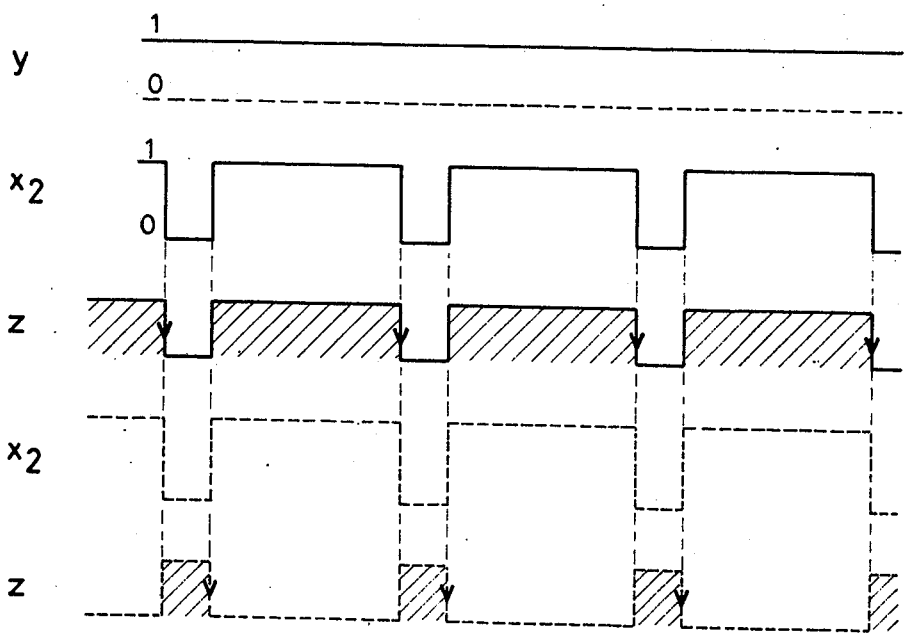
FIG. 3 is a diagram of the signals at various points of a variation of the device in which the ignition signals are taken at the output of the delaying circuit.

In these two devices the coil charges during the hatched areas of FIGS. 2 and 3 respectively. In FIG. 2, the upper half is a diagram of signals when y is in the state 1; the lower half is a diagram when $y$ is in the state 0. In FIG. 3, $x1$ is not shown (x1 being equal to $x2$) and the upper half relates $x2$ to $z$ when $y = 1$; the lower half relates $x2$ to $z$ when $y = 0$.

Such devices thus premit the current consumption through the coil to be limited, and as a result the protection of the said coil when the supply voltage is very high.

According to the embodiment described in French Pat. No. 73.25419, the means for protection against accidental reversal of polarity of the additional supply source are constituted, on the one hand by a diode connected in its direction of conduction, between the positive pole of the device and the collector of the transistor constituting the input stage of the amplifier and, on the other hand by a diode connected in its direction of conduction between the emitter of the transistor, disposed in series with the primary circuit of the voltage step-up coil, and the negative pole of the device. However, in this embodiment, the power amplifier stage is not protected against the formation of high frequency oscillations which may appear at the instant of ignition.

The disadvantage is also present in the device shown in FIG. 1 of the present invention.

This disadvantage can be remedied by the addition of a third diode connected in its direction of conduction between the emitter of the transistor disposed in series with the primary circuit of the voltage step-up coil and the base of the transistor constituting the input stage of the amplifier element, and of a condenser connected in parallel at the terminals of the third diode.

Figure 4:
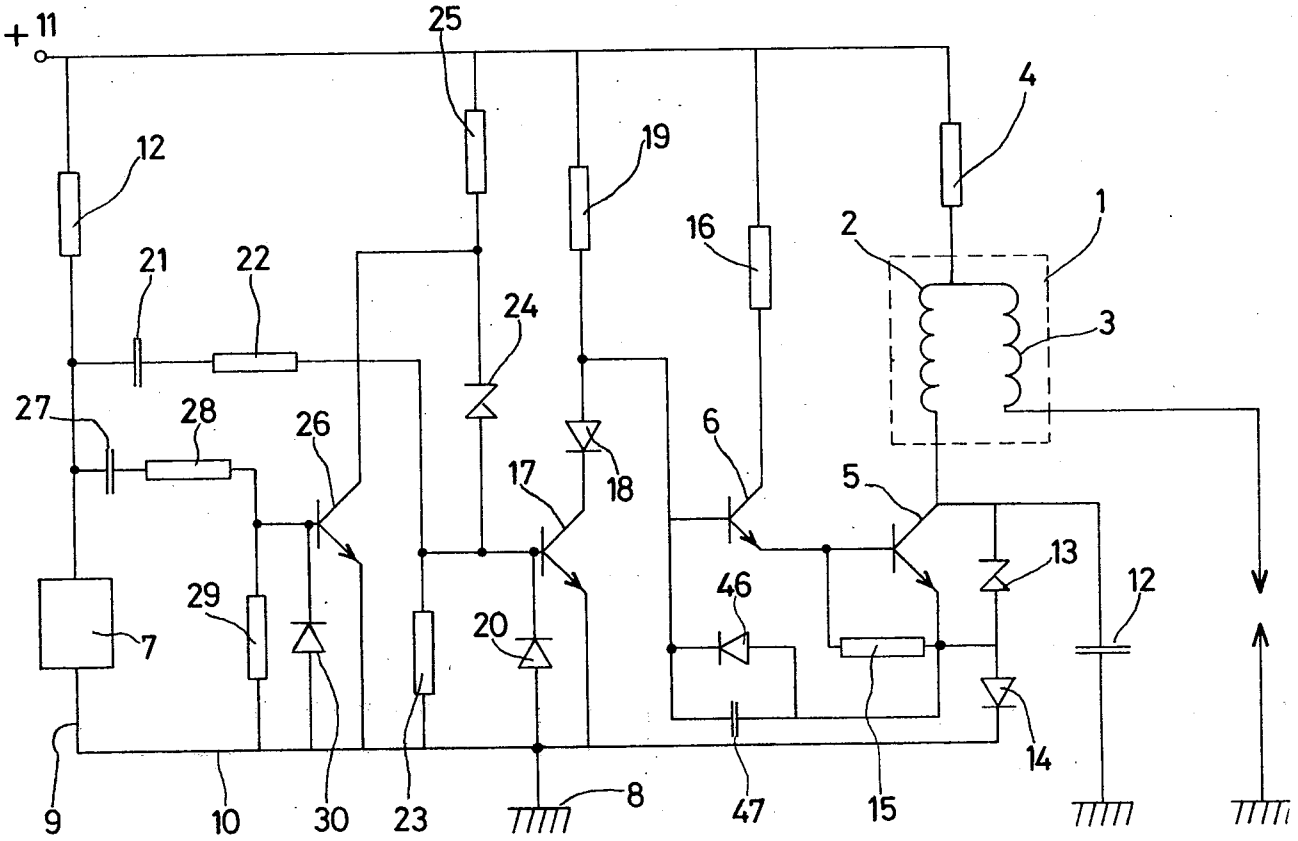
FIG. 4 shows schematically a second vibration of the device which shows only the protection of the amplifier element.

Referring to FIG. 4, there is shown a system having a voltage step-up coil 1, with a primary winding 2 and a secondary winding 3, a current limiting resistance 4, a control circuit connected to the primary winding 2 of the coil 1, which circuit includes a switching transistor 5, a transistor 6 for amplifying the ignition triggering signal, a control transistor 17 and an element 7 for triggering the ignition signal.

The base of the control transistor 17 is connected to a circuit called an "included dwells circuit" constituted by a diode 20, connected into the discharge circuit of a condenser 21, in such a way that its direction of passage is opposite to the charging circuit of the condenser passing through the charging circuit of the condenser passing through the resistances 22 and 23 and the emitter-base junction of the transistor 17.

A second circuit, constituted by a transistor 26, a condenser 27, a diode 30 and two resistances 28 and 29, controls the base of the transistor 17 when the Zener diode 24 is in operation when a supply source is connected.

According to French Pat. No. 73.25419, the protection against inverse polarities, when a supply source is connected for the amplifier stage, is effected by means of the two diodes 14 and 18, now, it has been established that with these two diodes alone, the protection of the transistors 5 and 6 is not effected, particularly when the voltage of the primary of the coil is negative, because of transistory over-voltages.

After many tests, the Applicant has noted that by connecting to the device shown in FIG. 4 a diode 46 and a condenser 47 in parallel between the base of the transistor 6 and the emitter of the transistor 5, the desired protection is obtained by giving values to the elements of the amplifier stage, given by way of example in the table below:

| Desigation | : | Reference |
|---|---|---|
| Diode 14 | : | 20 A, 200 V |
| Diode 18 | : | switching diode |
| Diode 46 | : | switching diode |
| Condenser 47 | : | 0.1μ F 20% |
| Transistor 5 | : | SES 607 (SESCO) or equivalent |
| Transistor 6 | : | 2 N 3054 or 2 N 5496 or equivalent |
| Transistor 17 | : | BC 337 cl 25 or equivalent |

Such a device gives a high level of protection to the amplifier stage, particularly at the moment when there are negative voltage values at the primary of the coil during ignition.

It is clear to a person skilled in the art that this protection is also applicable with the same effectiveness in the device shown in FIG. 1.

I claim:

1. An electronic ignition device for an internal combustion engine comprising a power amplifier having an input transistor and an output transistor, a control circuit for the input transistor for rendering the output transistor alternately conductive and non-conductive, a step-up coil having a primary winding connected in series with the output transistor and a secondary winding in which a high spark inducing voltage is produced when the output transistor becomes non-conductive, over-voltage protection means operable to render the output transistor non-conductive when supply voltage is abnormally high, overriding means for overriding the protection means for a short duration in each operation of triggering means forming part of the control circuit, and a paralell diode-capacitor combination conneccted between the base of the input transistor and the emitter of the output transistor, to protect the power amplifier against high voltage reverse transients induced in the primary winding during operation of said overriding means.

2. An electronic ignition device for an internal combustion engine, particularly for a motor vehicle, which device is of the type having an ignition signal triggering means, a voltage step-up coil, means for protection, acting to block the output stage, of a power amplifier, when a voltage source of higher value than the normal usage value is used during the starting phase of the engine, and means for cutting out this protection, by means of a delay circuit, for a sufficient duration to ensure the production of an ignition spark at the electrodes of at least one plug, wherein said protection means comprises a logic circuit which receives information signals from the delay circuit, and from the protection circuit of the power amplifier, such that, the supply voltage being greater than a defined value, the duration of charge of the coil is very sharply reduced, said logic circuit also receiving an information signal from the triggering means such that at normal supply voltage the triggering means alone controls conduction and non-conduction of the output transistor, whereas at excessive supply voltages the delay means exercises such control, said logic circuit further being constituted by a first "NAND" gate which receives, on the one hand, through a logical inverter the information signals from the triggering means, and on the other hand, the information signals from the protection means, by a second "NAND" gate which receives, on the one hand, the information signals from the delay means and, on the other hand, through a logical inverter the information signals from the protection means and by a third "NAND" gate which receives the information signals from the first two "NAND" elements.

3. An electronic ignition device for an internal combustion engine, particularly for a motor vehicle, which device is of the type having an ignition signal triggering element, a voltage step-up coil, means for protection, acting to block the output stage, of a power amplifier, when a voltage source of higher value than the normal usage value is used during the starting phase of the engine, and means for cutting out this protection, by means of a delay circuit, for a sufficient duration to ensure the production of an ignition spark at the electrodes of at least one plug, wherein said protection means comprises a logic circuit which receives information signals from the delay circuit, and from the protection circuit of the power amplifier, such that, the supply voltage being greater than a defined value, the duration of charge of the coil is very sharply reduced, said device further comprising a diode connected between the emitter of a transistor forming the output stage of the power amplifier and the base of a transistor forming the input stage of the power amplifier, and a capacitor connected in parallel with the diode, the arrangement being such as to protect the transistors when the voltage of a primary coil connected, in use, in series with the output transistor becomes negative as a result of transient overvoltages.

* * * * *